US007748977B2

(12) United States Patent
Mochizuki et al.

(10) Patent No.: US 7,748,977 B2
(45) Date of Patent: Jul. 6, 2010

(54) IGNITER

(76) Inventors: Tetsuya Mochizuki, 3-4 Shimohara, Subasiri, Oyama-cyo, Sunto-gun, Shizuoka (JP) 410-1431; Makoto Sato, 3-4 Shimohara, Subasiri, Oyama-cyo, Sunto-gun, Shizuoka (JP) 410-1431; Takayuki Suzuki, 3-4 Shimohara, Subasiri, Oyama-cyo Sunto-gun, Shizuoka (JP) 410-1431

( * ) Notice: Subject to any disclaimer, the term of this patent is extended or adjusted under 35 U.S.C. 154(b) by 181 days.

(21) Appl. No.: 10/578,852

(22) PCT Filed: Nov. 4, 2004

(86) PCT No.: PCT/JP2004/016709

§ 371 (c)(1),
(2), (4) Date: Jul. 5, 2007

(87) PCT Pub. No.: WO2005/045317

PCT Pub. Date: May 19, 2005

(65) Prior Publication Data

US 2008/0057454 A1 Mar. 6, 2008

(30) Foreign Application Priority Data

Nov. 10, 2003 (JP) ..... 2003-379762

(51) Int. Cl.
*F23D 11/36* (2006.01)

(52) U.S. Cl. ..... 431/153; 431/243; 431/266; 431/277; 431/254; 431/344

(58) Field of Classification Search ..... 431/153, 431/243, 266, 277, 255, 344, 345, 25, 254, 431/258; 81/450
See application file for complete search history.

(56) References Cited

U.S. PATENT DOCUMENTS

| | | | | |
|---|---|---|---|---|
| 4,028,968 | A * | 6/1977 | DeAmicis | 81/450 |
| 4,146,236 | A * | 3/1979 | Tsukamoto | 369/248 |
| 4,300,198 | A * | 11/1981 | Davini | 700/264 |
| 4,352,494 | A * | 10/1982 | Wells | 473/449 |
| 6,093,017 | A * | 7/2000 | Saito et al. | 431/153 |
| 6,488,492 | B2 * | 12/2002 | Adams et al. | 431/153 |
| 6,505,142 | B1 * | 1/2003 | Inoue et al. | 702/173 |

FOREIGN PATENT DOCUMENTS

| | | |
|---|---|---|
| JP | 59(1984) 77493 | 12/1985 |

* cited by examiner

*Primary Examiner*—Steven B McAllister
*Assistant Examiner*—Avinash Savani
(74) *Attorney, Agent, or Firm*—Trojan Law Offices

(57) ABSTRACT

An igniter includes an igniter body provided with a liquefied gas reservoir, and a rod-like extension, which extends from the igniter body and has a flame port ejecting gas flame therethrough on its leading end. The base portion of the rod-like extension is supported for rotation with respect to the igniter body so that the angle made between the igniter body and the rod-like extension can be changed to change the direction of the flame port in a free state and locked when the igniting action is to be done.

6 Claims, 7 Drawing Sheets

IGNITER

IDENTIFICATION AS NATIONAL STAGE AND PRIORITY CLAIM

This application is a submission to enter the national stage under 35 U.S.C. §371 and 37 CFR 1.495 from a PCT application PCT/JP2004/016709 filed on Nov. 4, 2004. This application claims priority to Japanese application No. 2003-379762 filed on Nov. 10, 2003, on which the PCT application is based.

BACKGROUND OF THE INVENTION

1. Field of the Invention

This invention relates to an igniter, which ejects gas flame through a flame port on the leading end of the rod-like extension extending from an igniter body in response to igniting action on the igniter body, and more particularly to structure of changing the direction of the flame port in such an igniter.

2. Description the Related Art

An igniter where a rod-like extension extends from an igniter body provided with a liquefied gas fuel reservoir and a gas flame is ejected through a flame port on the leading end of a tip pipe forming the rod-like extension so that the distance between the igniting position and the igniting action position is increased to facilitate the igniting action, has been commercially available and has been in wide use.

There has been proposed a gas igniter, where a part of the tip pipe in the rod-like extension is formed by a flexible member so that the direction of a flame port can be changed and the tip pipe can be inserted into a bent part to ignite. (See, for instance, Japanese Unexamined Patent Publication No. 9(1997)-133359.)

However, such an igniter has a difficulty in its handling when, since the tip pipe of the rod-like extension is formed by a flexible member like a spring and the shape of the tip pipe is changed through abutment against or the like in such an igniter, there is no wall surface against which the tip pipe is to be abutted and it is difficult to initially insert the rod-like extension gripping the igniter body.

That is, in the conventional igniter, where the rod-like extension is rigid and connected straight to the igniter body, there are cases where the user must take an unreasonable position to ignite through an igniting port of a gas appliance, and where an excellent ignition cannot be obtained due to an obstacle existing on the straight extension of an igniting port of a gas appliance which obstructs insertion of the rod-like extension into a regular igniting position. This can be overcome by forming the tip pipe of the rod-like extension by a flexible member as disclosed in Japanese Unexamined Patent Publication No. 9(1997)-133359. That is, when the tip pipe of the rod-like extension is formed by a flexible member as disclosed in Japanese Unexamined Patent Publication No. 9(1997)-133359, the leading end of the tip pipe abuts against a wall surface of the igniting port or the like so that the tip pipe is deformed along the insertion path to be able to be inserted to the igniting port. However, this approach is disadvantageous in that it cannot be inserted to the igniting port unless a wall surface and the leading end of the tip pipe can be rubbed against the wall surface to be stained to deteriorate the ignitability.

Especially, in the case where the rod-like extension is fixed to the igniter body, since the rod-like extension is directed in the same direction as the igniter body with movement of the igniter body in various directions, e.g., up and down or the right and left, the rod-like extension itself is inclined to make it difficult formation of a gas flame when the flame port is applied to an object to be ignited with the igniter body inclined with respect to the object.

SUMMARY OF THE INVENTION

In view of the foregoing observations and description, the primary object of the present invention is to facilitate changing the direction in which the rod-like extension is directed with respect to the igniter body to improve the ignitability.

The igniter of the present invention comprises an igniter body provided with a liquefied gas reservoir, and a rod-like extension which extends from the igniter body and has a flame port ejecting gas flame there through on the leading end thereof, wherein the base portion of the rod-like extension is supported for rotation with respect to the igniter body so that the angle made between the igniter body and the rod-like extension can be changed in a free state and locked when the igniting action is to be done.

It is preferred that a rotation base provided with a ring portion for the rod-like extension be inserted for rotation into a holding portion having an annular guide portion of the igniter body so that the angle made between the igniter body and the rod-like extension can be changed in a free state.

It is preferred that the igniter body is further provided with a lock lever for locking the igniting action in the free state. It is preferred that a part of the lock lever interferes with a part of the rod-like extension, when the lock lever is operated to release the lock, to fix the angle between the igniter body and the rod-like extension.

A tension member, which urges the rod-like extension to one direction with respect to the igniter body may be provided.

Another igniter of the present invention comprises an igniter body provided with a liquefied gas reservoir, and a rod-like extension which extends from the igniter body and has a flame port ejecting gas flame therethrough on the leading end thereof, wherein the base portion of the rod-like extension is supported for rotation with respect to the igniter body, and the rod-like extension is balanced in weights of the front part and the rear part thereof opposite to each other with the center of rotation of the rod-like extension intervening therebetween to be held horizontal in a free state, and a mechanism for preventing the rotation of the rod-like extension is further provided.

Preferably, the base portion of the rod-like extension having a ring portion is inserted for rotation into a holding portion having an annular guide portion of the igniter body and a balance weight is positioned on the rod-like extension so that the rod-like extension horizontally balances and the angle of the igniter body can be changed in a free state.

It is preferred that the mechanism for preventing the rotation of the rod-like extension comprises a lock lever which interferes with a part of the base portion of the rod-like extension to prevent rotation thereof. The lock lever preferably locks the igniting action of the rod-like extension in a free state.

In accordance with the igniter according to the present invention, since the rod-like extension having a flame port ejecting gas flame therethrough on the leading end thereof is supported for rotation with respect to the igniter body provided with a liquefied gas reservoir so that the angle between the igniter body and the rod-like extension can be changed in a free state to change the direction of the flame port, change of the direction of the flame port is facilitated by fixing the angle between the rod-like extension and the igniter body. Accordingly, in the igniter according to the present invention, change of the direction of the rod-like extension is enabled whereby insertion of the rod-like extension into a corner of complicated wall surfaces or into a narrow gap is facilitated, handling of igniter can be effected with the igniter body gripped at an angle easy to grip and without rubbing the hand gripping the igniter body against the wall surface to give the flame port access to the igniting point so that an excellent ignition can be obtained.

When the products are too long or when the products are to be compactly transported, by increasing the bending angle of the igniter so that the rod-like extension is bent with respect to the igniter body, the igniters can be compact in the shapes and storage and/or transportation is facilitated.

Since the direction of the rod-like extension can be changed separately from the igniter body, the gas flame can be prevented from applying to fingers, hand, or the igniter body.

In accordance with said another igniter according to the present invention, since the rod-like extension having a flame port ejecting gas flame therethrough on the leading end thereof is supported for rotation with respect to the igniter body provided with a liquefied gas reservoir, and the rod-like extension is balanced in weights of the front part and the rear part thereof with respect to the center of rotation of the rod-like extension so that the rod-like extension is held horizontal in a free state, and a mechanism for preventing the rotation of the rod-like extension is further provided, change of the direction of the flame port is facilitated. Accordingly, in the igniter according to the present invention, change of the direction of the rod-like extension is enabled whereby insertion of the rod-like extension into a corner of complicated wall surfaces or into a narrow gap is facilitated, handling of igniter can be effected with the igniter body gripped at an angle easy to grip and without rubbing the hand gripping the igniter body against the wall surface to give the flame port access to the igniting point so that an excellent ignition can be obtained.

That is, it is either possible to change the direction of flame port by changing the direction of flame port by locking the angle between the igniter body and the rod-like extension after changing the angle of the igniter body with respect to the rod-like extension in the horizontal or by rotating the rod-like extension to the horizontal by first locking the rod-like extension from rotating with the rod-like extension in an inclined state and subsequently releasing the lock to a free state.

Since the rod-like extension is directed in a predetermined direction even if the igniter body is inclined, the flame forming direction of the leading end of the rod-like extension is unchanged and an excellent gas flame formation can be obtained even if the igniter body is inclined to position easy to use.

DESCRIPTION OF THE PREFERRED EMBODIMENTS

Embodiments of the present invention will be described in detail with reference to the drawings, hereinbelow.

First Embodiment

Figure 1:
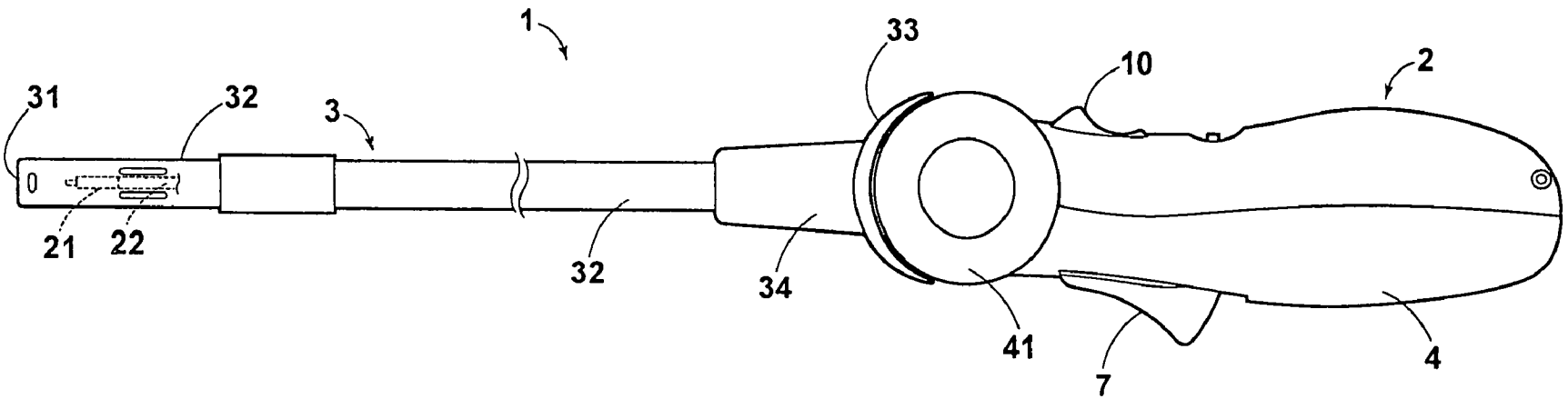
FIG. 1 is a side view showing a general appearance of an igniter in accordance with a first embodiment of the present invention.
Figure 2:
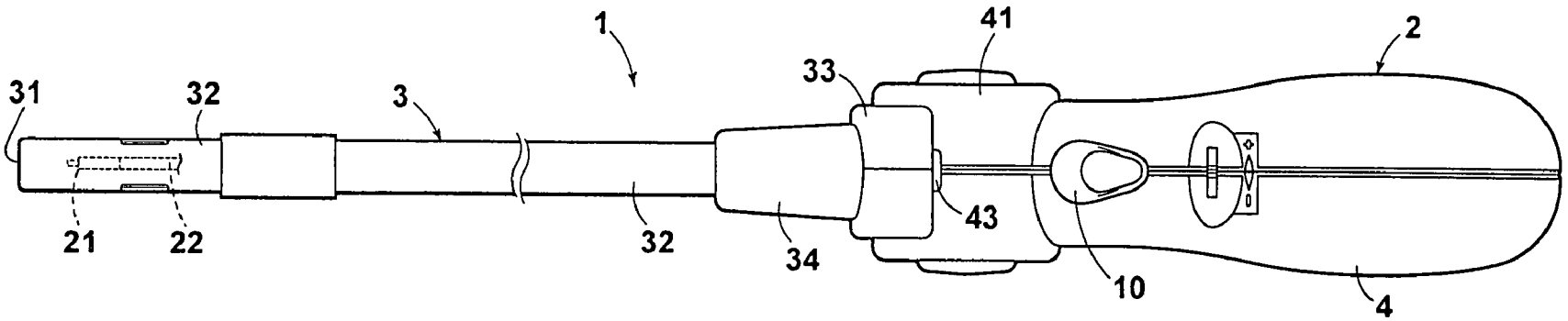
FIG. 2 is a plan view of FIG. 1.
Figure 3:
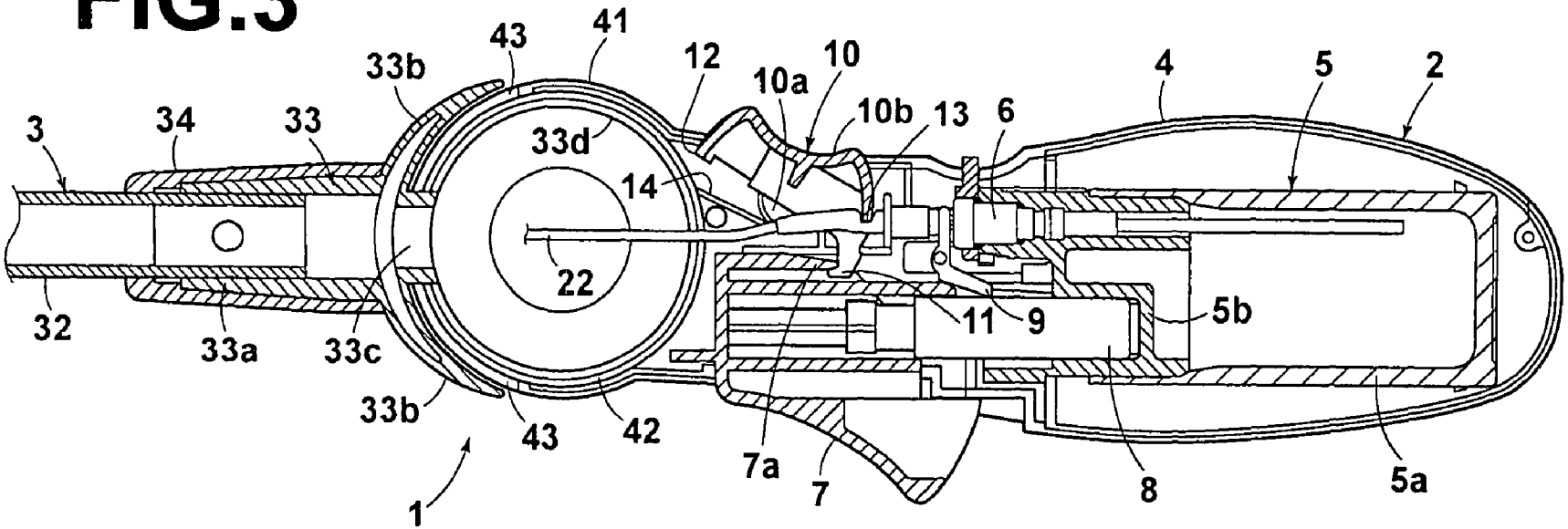
FIG. 3 is a side cross-sectional view showing an important part of the igniter shown in FIG. 1 in a free state.
Figure 4:
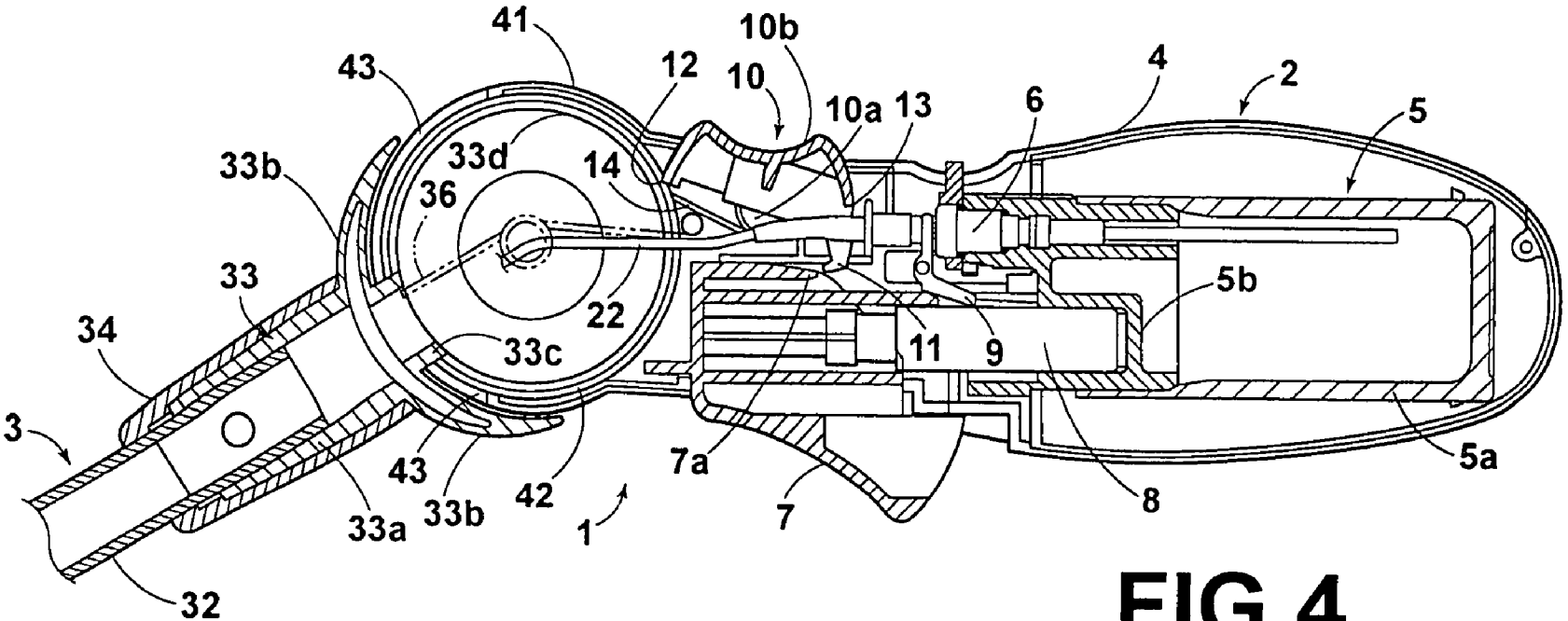
FIG. 4 is a side cross-sectional view showing the igniter shown in FIG. 3 but upon igniting action.

FIG. 1 is a side view showing a general appearance of an igniter in accordance with a first embodiment of the present invention, FIG. 2 is a general plan view, FIG. 3 is a side cross-sectional view showing an important part of the igniter in a free state, and FIG. 4 is a side cross-sectional view showing the igniter upon igniting action.

The igniter 1 of this embodiment comprises an igniter body 2 and a rod-like extension 3 extending from the igniter body 2. The igniter body 2 is covered with a casing 4 split right and left, and a gas reservoir 5 in which liquefied gas is stored is provided inside the rear portion of the casing 4. The gas reservoir 5 comprises an upper lid 5*b* connected to a reservoir body 5*a* and the upper lid 5*b* is provided with a valve mechanism 6 for opening and closing gas supply.

At the lower side of the intermediate portion of the casing 4, an igniting lever 7 is positioned to be slidable back and forth and a piezoelectric unit 8 which discharges an electric voltage in response to backward movement of the igniting lever 7 is provided rearward of the igniting lever 7 between the lever 7 and the gas reservoir 5. An interlocking lever 9 which is swung in response to backward movement of the igniting lever 7 is provided rearward of the igniting lever 7 and the interlocking lever 9 is interlocked with the igniting lever 7 so that the igniting action by the igniting lever 7 causes the valve mechanism 6 by way of the interlocking lever 9 to open to supply the gas. Further, upward of an intermediate portion of the casing 4, there is provided a lock lever 10, which locks the igniting lever 7 from being operated (to be described in detail later).

A cylindrical holding portion 41 is provided on the casing 4 opposed to the leading end portion of the igniter body 2. The holding portion 41 is made by the split halves, which are mated together to form a cylindrical outer shell and is provided with an annular guide portion 42 inside thereof. The guide portion 42 is formed with a space at the center thereof when parts of the split halves on its opposite sides are mated together and a gas pipe 22 to be described later, a cable not shown and the like are passed through the space. A slide groove 43 opens on the leading end of the holding portion 41 to extend in the circumferential direction according to the range of rotation of the rod-like extension 3.

A base portion 33 for rotation of the rod-like extension 3 is held for rotation by the holding portion 41. The rod-like extension 3 is provided with a flame port 31 on its leading end portion. Gas flame passes through the flame port 31 and the outer shell of the rod-like extension is formed by a tip pipe 32 made, for instance, of metal. The base portion 33 is mounted on the rear end of the outer shell of the rod-like extension 3 by a fixing cap 34. The base portion 33 comprises a connecting tubular portion 33*a* to which the tip pipe 32 is connected, a collar portion 33*b* which covers the front portion of the outer periphery of the holding portion 41, a ring portion 33*d* held inside the holding portion 41, and a junction rod portion 33*c* which connects the ring portion 33*d* and the collar portion 33*b*. Inside the connecting tubular portion 33*a* and the junction rod portion 33*c*, a passage is formed to communicate the insides of the tip pipe 32 and the igniter body 2 and the gas pipe 22 and the like are positioned to extend through the passage.

The ring portion 33*d* of the base portion 33 is inserted into the annular guide portion 42 to be held to rotate inside thereof. The ring portion 33*d* is larger than the annular guide portion 42 in width (height) and projects inward to be brought into abutment against a leading end 12 of the lock lever 10 (to be described later) to be fixed to suppress rotation of the rod-like extension 3. The junction rod portion 33*c* of the base portion 33 moves along the sliding groove 43 of the holding portion 41 in response to rotation of the rod-like extension 3, and the collar portion 33*b* extends in the circumferential direction to cover the outer opening of the sliding groove 43.

A gas nozzle (FIG. 1) 21 is disposed in the leading end of the rod-like extension 3. A leading end portion of the gas pipe 22 for supplying the gas from the valve mechanism 6 is connected to the rear end portion of the gas nozzle 21. The gas pipe 22 extends rearward inside the tip pipe 32 to be connected to the valve mechanism 6 at its rear end portion and is flexible, deformable and free in an intermediate portion to permit rotation of the base portion 33.

A covered cable (not shown) extends inside the tip pipe 32 and connected to the gas nozzle 21 at one end and to one pole of the piezoelectric unit 8 at the other end. Other covered cables (not shown) are connected to the tip pipe 22 at their first ends and to the other pole of the piezoelectric unit 8 at their other ends. With this arrangement, the piezoelectric unit 8 is electrically connected to the discharge electrodes (not shown) of the tip pipe 32 of conductive material and spark is obtained between the tip pipe 32 and the gas nozzle 21.

The base portion 33 of the rod-like extension 3 rotates about the holding portion 41 of the igniter body 2 to change the direction of the flame port 31 on the leading end. The rotation can be easily effected without resistance in a free state and the angle between the rod-like extension 3 and the igniter body 2 can be manually freely changed.

After the angle of the rod-like extension 3 to the igniter body 2 is adjusted, the igniting lever 7 is operated to open the valve mechanism 6 to supply the gas and to operate the piezoelectric unit 8 to discharge and ignite the gas by way of igniting action or the interlocking lever 9. However, the igniting lever 7 is locked by the lock lever 10 so that the igniting action cannot be effected by the igniting lever 7 so long as the base portion 33 thereof is in a free state.

The lock lever 10 is held for rotation on the casing 4 by a fulcrum 10*a* and has a control portion 10*b* exposed outside the casing 4 to swing the lock lever 10 rearward and forward. The lock lever 10 is provided with a lock portion 11 which projects downward from a rearward portion thereof. The lock portion 11 is moved toward the igniting lever 7 to be engaged with an engaging portion 7*a* thereof from rearward as shown in FIG. 3 upon depression inward of a rear portion of the control portion 10*b* to lock the igniting lever 7 from being moved rearward for in an igniting action. At that time, a pressing portion 13 on the rear end of the control portion 10*b* of the lock lever 10 squeezes a rear portion of the gas pipe 22 connected to the valve mechanism 6 to close the passage therein.

The lock lever 10 is further provided with a sliding contact portion 12 on the leading end of the control portion 10*b*. The sliding contact portion 12 extends toward the ring portion 33*d* of the base portion 33 of the rod-like extension 3 and is brought into a pressure contact with the outer periphery of the ring portion 33*d* when the front portion of the control portion 10*b* depressed inward to limit rotation of the ring portion 33*d* or the angle change of the rod-like extension 3 under the resistance, thereby fixing the ring portion 33*d* or the rod-like extension 3.

The lock lever 10 is provided with a torsional spring, an urging member 14, which urges the lock lever 10 in a return direction, and when the control portion 10*b* is released after the igniting action, the lock lever 10 is rotated in the return direction. When the rear portion of the control portion 10*b* of the lock lever 10 is pushed inward, the pressing portion 13 squeezes a rear portion of the gas pipe 22 to cut the gas supply and quenches the igniter 1.

The base portion 33 of the rod-like extension 3 may be provided with a torsional spring, that is, a tension member 36, which gives a tension in a direction thereto. A constant force is applied to the rod-like extension 3 by the tension member 36, so that the rod-like extension 3 is directed in a direction.

Operation of the igniter 1 will be described, hereinbelow. In a free state such as shown in FIG. 3, the base portion 33 of the rod-like extension 3 is easily rotated with respect to the holding portion 41 of the igniter body 2 so that the rod-like extension 3 can be freely changed in its angle, and the rod-like extension 3 is manually inclined in a desired direction. In the free state of base portion 33 (FIG. 3), ignition cannot be effected since the lock lever 10 locks the igniting lever 7. By pushing forward the lock lever 10 to swing it after the flame port 31 is changed to a desired angle with respect to the holding angle of the igniter body 2, the lock of the igniting lever 7 is released as shown in FIG. 4, and the further forward swing of the lock lever 10 brings the sliding contact portion 12 into a pressure contact with the outer periphery of the ring portion 33*d* of the base portion 33 to hold the rod-like extension 3 at an adjusted angular position.

Figure 7:
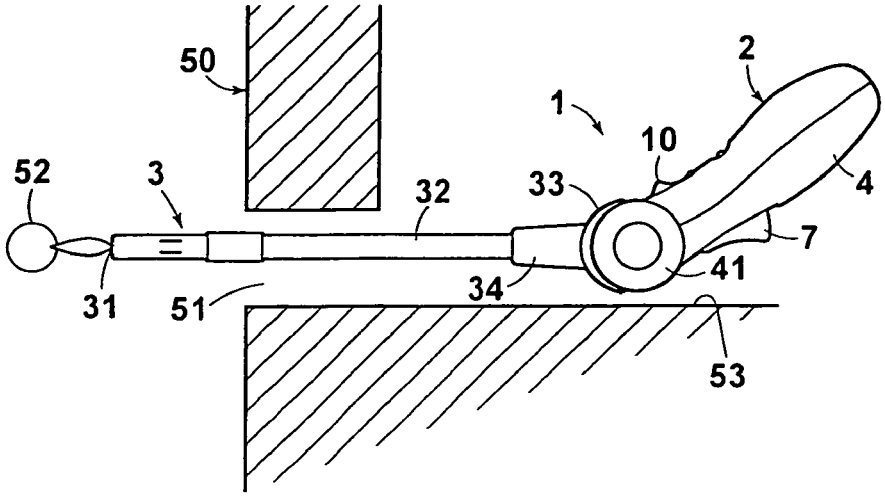
FIG. 7 is a view briefly showing an example of use of the igniter shown in FIG. 1.

When, for example, as shown in FIG. 7, insertion into an ignition port 51 opposed to an ignition point 52 of an combustor 50 gripping the igniter body 2 is difficult with the igniter body 2 and the rod-like extension 3 held straight due to the hand rubbing against the floor surface 53, the rod-like extension 3 is inserted straight into the ignition port 51 toward the ignition point 52 after the angle between the rod-like extension 3 and the igniter body 2 is changed. At this time, since, in the igniter of this embodiment, the igniter body 2 has a sufficient angle with respect to the floor surface 53, a gas flame can be ejected from the flame port 31 in response to control of the igniting lever 7 without rubbing the hand gripping the igniter body 2 against the wall surface 53 and the control of ignition can be improved.

After ignition, the igniting lever 7 is returned to the original position under the force of the spring built in the piezoelectric unit 8 and the lock lever 10 is returned to the original position by the urging member 14 and releases the limitation of rotation of the rod-like extension 3 to release fixing of the direction of the flame port 31 and is returned to the free state in response to release from the hand. Further, when the lock lever 10 is returned to the original position shown in FIG. 3, the gas pipe 12 is squeezed to cut the gas supply and the igniter 1 is quenched.

In accordance with this embodiment, since the angle of the rod-like extension 3 with respect to the igniter body 2 can be easily changed, insertion of the igniter 1 into the ignition port 51 leading to the ignition point 52 is facilitated when the combustor 50 such as a stove, kitchen fitments or the like or the material to be ignited such as charcoal, wood or the like is to be ignited. When the base portion 33 of the rod-like extension 3 is in a free state, operation of the igniting lever 7 is unable, whereby no gas flame can be accidentally ejected from the flame port 31 when the flame port 31 is directed an unintended direction. Further, since rotation of the rod-like extension 3 is limited by the lock lever 10 and the igniting action, carried out with the angle of the rod-like extension 3 kept unchanged, a targeted ignition point 52 can be surely ignited. Further, gas can be cut in response to locking operation of the lock lever 10 after ignition and the igniter 1 can be surely quenched.

Limitation of rotation of the base portion 33 by the lock lever 10 may be effected by various interference structures other than the frictional structure described above. For example, a structure where a hook is engaged with a cutaway groove may be employed and the base portion 33 is fixed in any rotational position.

Second Embodiment

Figure 5:
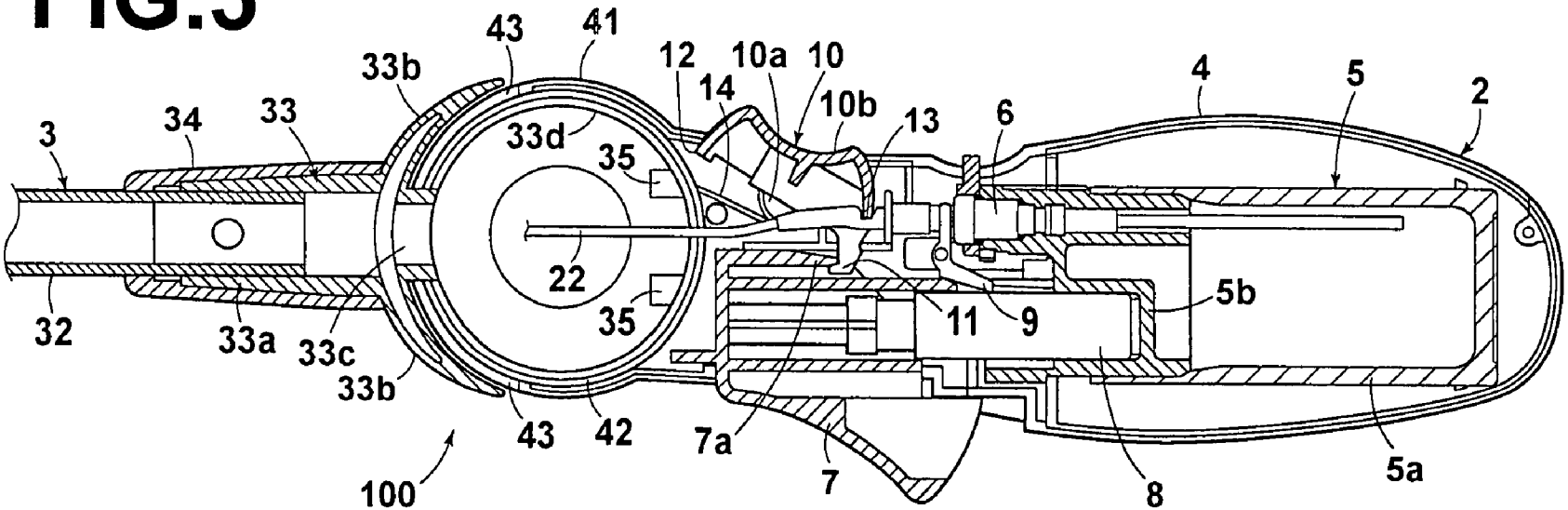
FIG. 5 is a side cross-sectional view showing an important part of the igniter in a free state in accordance with a second embodiment of the present invention.
Figure 6:
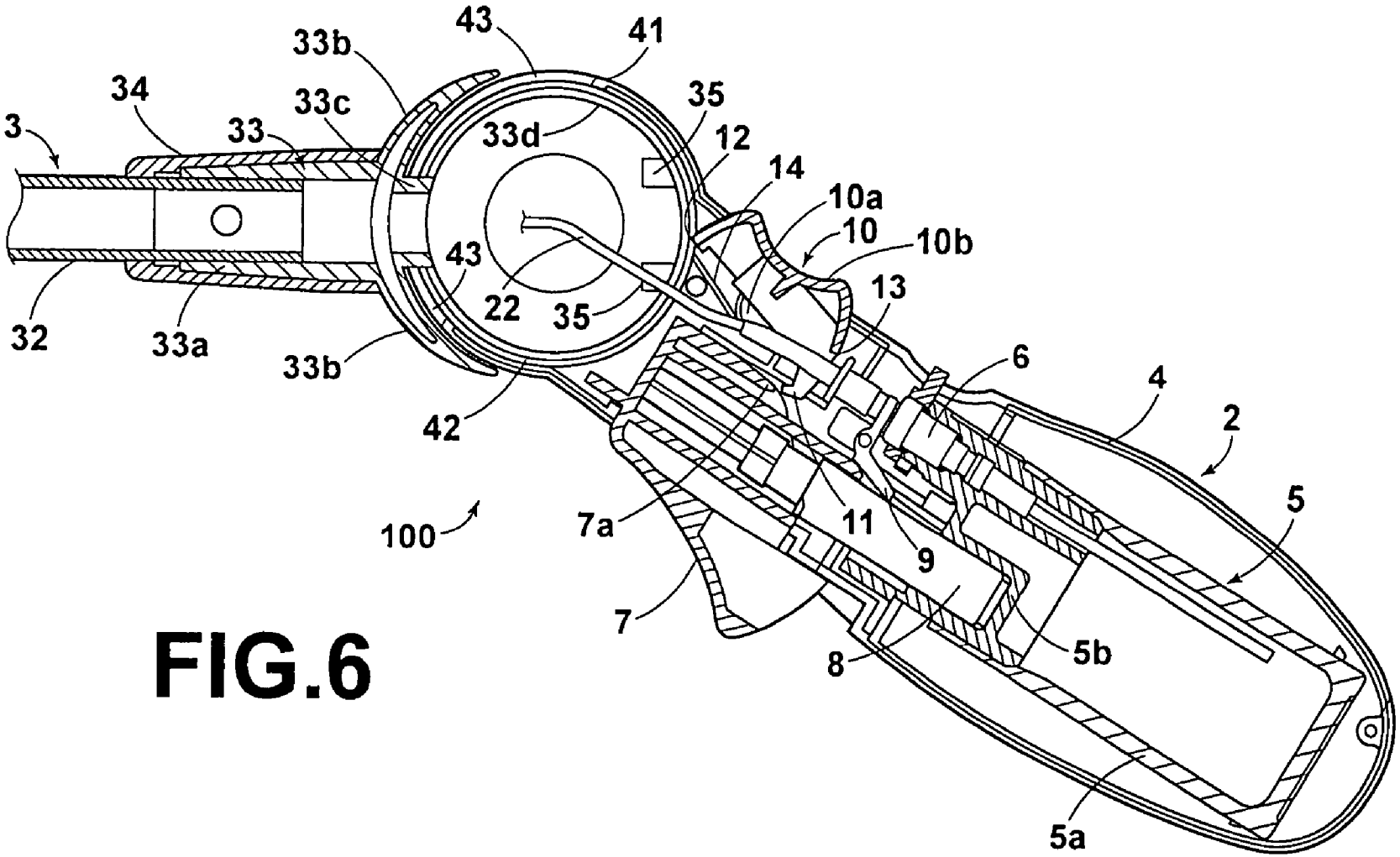
FIG. 6 is a side cross-sectional view showing the igniter shown in FIG. 5 but upon igniting action.

FIG. 5 is a side cross-sectional view showing an important part of the igniter in a free state in accordance with a second embodiment of the present invention, and FIG. 6 is a side cross-sectional view showing the igniter shown in FIG. 5 but upon igniting action. The general side view and the general plan view of the igniter 100 of this embodiment are the same as FIGS. 1 and 2 for the preceding embodiment, and the igniter 100 of this embodiment is the same as the first embodiment except balance weights 35 are added inside. Accordingly, in the second embodiment, the elements analogous to those in the first embodiment are given the same reference numerals and will not be described, here.

The base portion 33 of the rod-like extension 3 of the igniter 100 of this embodiment held for rotation up and down in the holding portion 41 of the casing 4 in the igniter body 2 comprises the connecting tubular portion 33*a*, the collar portion 33*b*, the junction rod portion 33*c* and the ring portion 33*d* and is further provided with balance weights 35 positioned on the inner circumferential surface of the ring portion 33*d* opposite to the junction rod portion 33*c*.

The balance weights 35 are for balancing in weight with the tip pipe 32 opposite to the center of rotation of the holding portion 41 so that the rod-like extension is constantly held horizontal in a free state. After the angle of the igniter body 2 with respect to the rod-like extension 3 held horizontal is changed, the angle between the igniter body 2 and the rod-like extension 3 is fixed by operation of the mechanism for fixing rotation including the lock lever 10, whereby the direction of the flame port 31 is changed. Otherwise, rotation of the rod-like extension 3 is first fixed by operation of the lock lever 10, and then the rod-like extension 3 is turned to the free state by releasing the lock after the rod-like extension 3 is inclined, whereby the rod-like extension 3 is rotated to the horizontal and the direction of the flame port 31 is changed.

Then, as in the first embodiment, the base portion 33 of the rod-like extension 3 rotates about the holding portion 41 of the igniter body 2 and the direction of the flame port 31 is, thereby, changed. The rotation of the base portion 33 can be easily effected without resistance in a free state to freely change the angle between the igniter body 2 and the rod-like extension 3. When the base portion 33 is in a free state, the igniting lever 7 is locked by the lock lever 10 so as not to be operated.

Operation of the igniter 100 will be described, hereinbelow. In a free state such as shown in FIG. 5, the base portion 33 of the rod-like extension 3 is easily rotated with respect to the holding portion 41 of the igniter body 2 and the balance weights 35 act on the rod-like extension 3 to keep horizontal, and accordingly, the angle between the igniter body 2 and the rod-like extension 3 can be freely changed for instance, by inclining the igniter body 2 as shown in FIG. 6. When the base portion 33 is in a free state, the ignition cannot be effected since the igniting lever 7 is locked by the lock lever 10 so as not to be operated. The lock of the igniting lever 7 is released by swinging forward the lock lever 10 after the angle of the igniter body 2 with respect to the direction of the flame port 31 is changed to a desired angle and by further swinging forward the lock lever 10, the sliding contact portion 12 of the lock lever 10 is brought into contact with the outer periphery of the ring portion 33*d* of the base portion 33 as shown in FIG. 6 and the rod-like extension 3 can be kept in any adjusted angular position.

When, for example, in the case where insertion to an ignition port 51 opposed to an ignition point 52 of an combustor 50 gripping the igniter body 2 is difficult as in the case shown in FIG. 7 with the igniter body 2 and the rod-like extension 3 held straight due to the hand rubbing against the floor surface 53, the rod-like extension 3 is inserted straight into the ignition port 51 toward the ignition point 52 after the angle between the rod-like extension 3 and the igniter body 2 is changed. At this time, since, in the igniter 100 of this embodiment, the igniter body 2 has a sufficient angle with respect to the floor surface 53, a gas flame can be ejected from the flame port 31 in response to control of the igniting lever 7 without rubbing the hand gripping the igniter body 2 against the wall surface 53 and the control of ignition can be improved.

Figure 8:
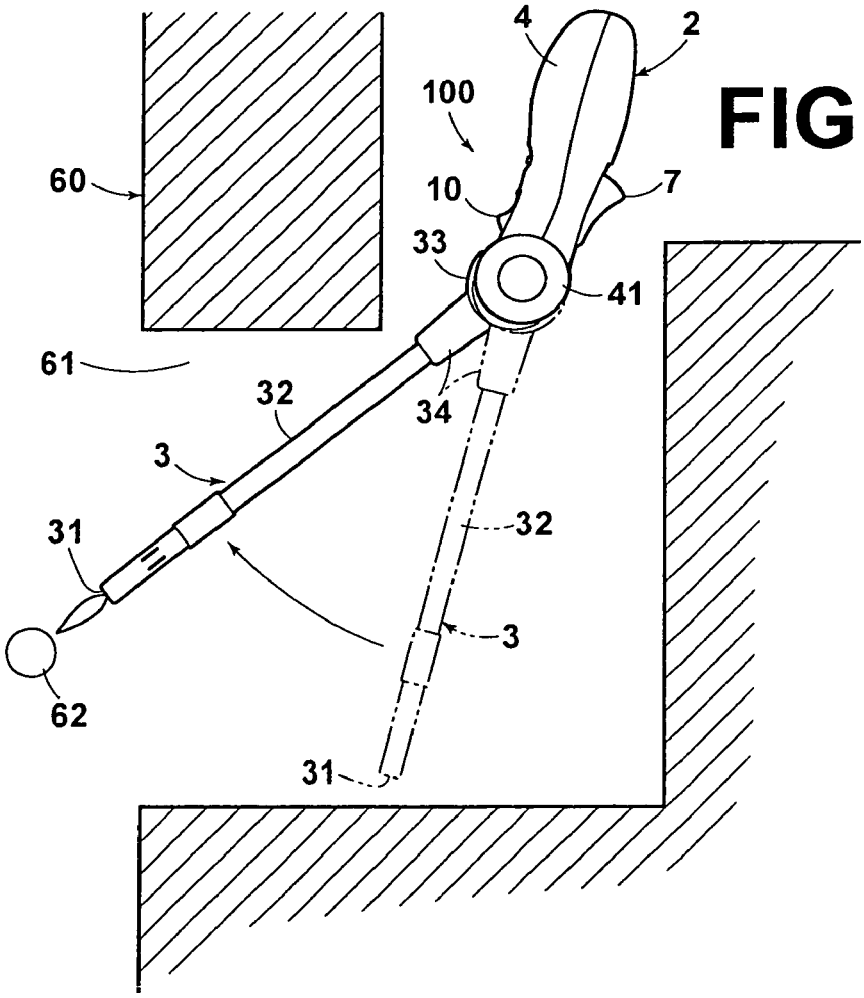
FIG. 8 is a view briefly showing an example of use of the igniter shown in FIG. 5.

The lock lever 10 is controlled to the rotation lock state from the lock release state in the state shown in FIG. 5 to first lock rotation of the rod-like extension 3. In the state, the rod-like extension 3 in an inclined state is inserted into an ignition port 61 opposed to an ignition point 62 of an combustor 60 in another form as shown by the chained line in FIG. 8 and the lock of rotation by the block lever 10 is subsequently released to make free the rod-like extension 3, and then the rod-like extension 3 is rotated toward the horizontal shown by the solid line to change the direction of the flame port 31 toward the ignition point 62. Though, in the case shown in FIG. 8, the rod-like extension 3 is not rotated to the horizontal due to limitation of rotation of the base portion 33, the rod-like extension 3 can be rotated to a position where the rod-like extension 3 is nearly right to the igniter body 2 by setting large the range of rotation of the rod-like extension 3. Then a gas flame is ejected from the flame port 31 in response to control of the igniting lever 7. With this arrangement, the control of ignition can be improved.

In accordance with this arrangement, since the angle of the rod-like extension 3 is kept horizontal to the igniter body 2 by virtue of the balance weights 35 and the angle of the rod-like extension 3 with respect to the igniter body 2 can be easily changed to any angle, insertion of the igniter 1 into the ignition port 51 or 61 leading to the ignition point 52 or 62 is facilitated when the combustor 50 such as a stove, kitchen fitments or the like or the material to be ignited such as charcoal, wood or the like is to be ignited. When the base portion 33 of the rod-like extension 3 is in a free state, operation of the igniting lever 7 is unable, whereby no gas flame can be accidentally ejected from the flame port 31 when the flame port 31 is directed an unintended direction. Further, since rotation of the rod-like extension 3 is limited by the lock lever 10, and the igniting action carried out with the angle of the rod-like extension 3 is kept unchanged, a targeted ignition point 52 can be surely ignited. Further, gas can be cut in response to locking operation of the lock lever 10 after ignition and the igniter 1 can be surely quenched.

What is claimed is:

1. An igniter comprising:

an igniter body, said igniter body provided with a liquefied gas reservoir, and said igniter body having a holding portion;

a rod-like extension which extends from the igniter body for ejecting a gas flame, said rod-like extension having a base portion, said base portion supported for rotation on said holding portion;

a lock lever rotatably mounted on an external a top side of said igniter body for direct operation by a user and an igniting lever mounted on a bottom side of said lighter body;

said lock lever capable of rotating in a first direction to lock said igniting lever, said lock lever capable of rotating in a second direction opposite to said first direction to engage said base portion of said rod-like extension to interfere with the rotation of said rod-like extension when the lock lever is operated to release the lock of the igniting lever; wherein the rod-like extension rotates with respect to the igniter body so that the angle made between the igniter body and the rod-like extension can be changed to change the direction of the flame port in a free state and locked when the igniting action is to be done wherein the igniting lever is free to affect the igniting action only when the rod-like extension is in the locked state.

2. An igniter as defined in claim 1, in which said base portion of the rod-like extension has a ring portion that rotates about an annular guide portion of said holding portion of the igniter body so that the angle made between the igniter body and the rod-like extension can be changed in a free state.

3. An igniter as defined in claim 1, in which a part of the lock lever interferes with a part of the rod-like extension, when the lock lever is operated to release the lock, to fix the angle between the igniter body and the rod-like extension.

4. An igniter as defined in claim 1 or 2 further comprising a tension member, which urges the rod-like extension to one direction with respect to the igniter body.

5. An igniter comprising:

an igniter body, said igniter body provided with a liquefied gas reservoir, and a rod-like extension which extends from the igniter body and has a flame port ejecting gas flame therethrough on the leading end thereof a lock lever mounted on an external a top side of said igniter body for direct operation by a user, said lock lever capable of engaging a base portion of said rod-like extension to interfere with the rotation of said rod-like extension, wherein the base portion of the rod-like extension is supported for rotation with respect to the igniter body, and the rod-like extension is balanced by weights positioned on the ring portion of the base portion of the rod-like extension opposite to each other, with the center of rotation of the rod-like extension intervening between the weights and said flame port of the rod-like extension such that said rod-like extension is rotationally balanced in a free state wherein the lock lever is capable of engaging the base portion of the rod-like extension to interfere with rotation at any angle between a minimum and maximum angle of rotation of the rod-like extension.

6. An igniter as defined in claim 5, in which the lock lever locks the igniting action of the rod-like extension in a free state.

* * * * *